US005081959A

United States Patent [19]

Akiyama

[11] Patent Number: 5,081,959

[45] Date of Patent: Jan. 21, 1992

[54] COOLING ARRANGEMENT FOR PISTON HEAD OF INTERNAL COMBUSTION ENGINE

[75] Inventor: Katsuji Akiyama, Kanagawa, Japan

[73] Assignee: Atsugi Unisia Corp., Japan

[21] Appl. No.: 634,727

[22] Filed: Dec. 27, 1990

[30] Foreign Application Priority Data

Dec. 29, 1989 [JP] Japan ..... 1-151602[U]

[51] Int. Cl.[5] ..... F01P 1/04

[52] U.S. Cl. ..... 123/41.35; 92/186

[58] Field of Search ..... 123/91.35; 92/186

[56] References Cited

FOREIGN PATENT DOCUMENTS

| | | | |
|---|---|---|---|
| 1141494 | 12/1962 | Fed. Rep. of Germany | 123/41.35 |
| 62-168955 | 7/1987 | Japan | 123/41.35 |
| 769919 | 3/1957 | United Kingdom | 123/41.35 |

*Primary Examiner*—Noah P. Kamen
*Attorney, Agent, or Firm*—Ronald P. Kananen

[57] ABSTRACT

A cooling arrangement for a piston head of an internal combustion engine including a plurality of cooling channels built-in to the piston head. Cooling medium induction paths and draining paths are formed through the piston head for introducing and draining cooling medium into and from the cooling channels. A single cooling medium injection nozzle is disposed within the engine cylinder. The cooling medium injection nozzle is oriented to inject the cooling medium so that an axis of a jet flow of the cooling medium injected from the cooling medium injection nozzle is aligned with the axes of the cooling medium induction paths at different stroke positions of a piston during an engine revolution cycle.

5 Claims, 3 Drawing Sheets

COOLING ARRANGEMENT FOR PISTON HEAD OF INTERNAL COMBUSTION ENGINE

BACKGROUND OF THE INVENTION

1. Field of the Invention

The present invention relates generally to a cooling arrangement for a piston head of an internal combustion engine. More specifically, the invention relates to a cooling arrangement for a piston head, which can effectively cool the piston head at various engine cycle positions.

2. Description of the Background Art

As is well known, a piston head is an engine part which is directly exposed to an engine combustion chamber to receive combustioning pressure for transmitting force generated by combustion to a crankshaft via a piston rod. Therefore, the piston head is constantly subject to substantially high heat in the combustion chamber. The piston head is thus required to be effectively cooled to expand lift and optimize engine performance. In order to cool the piston head, there has been proposed a piston head which is formed with a cooling channel therein. A lubricating oil is introduced into the cooling channel by injection through a lubricant injection nozzle which is disposed in an engine cylinder through an engine cylinder block. Such an arrangement is provided for effectively cooling the top portion of the piston head, which is directly subject to high heat in the engine combustion chamber.

In this type of piston head cooling arrangement, it is important to effectively introduce the lubricating oil into the cooling channel. As can be appreciated, the position of the piston head varies between the top-dead-center (TDC) and the bottom-dead center (BDC) according to an engine revolution cycle. A difficulty is thus encountered in effectively introducing the lubricating oil into the cooling channel at various positions of the piston head. Namely, if the lubricant injection nozzle is facilitated to inject the lubricating oil for effective introduction into the cooling channel at the BDC of the piston head, the axis of flow of the injected lubricating oil will be offset from the axis of a lubricant induction path for the cooling channel at the TDC of the piston head. As a result, induction efficiency of the lubricating oil at the TDC can be lowered thereby causing a lowering of cooling efficiency.

In order to overcome this difficulty, Japanese Utility Model First (unexamined) Publication (Jikkai) Showa 61-144242 proposes a multi-nozzle system which has a plurality of lubricant injection nozzles. Namely, according to the disclosed embodiment, there is provided first and second lubricant injection nozzles. The first and second lubricant injection nozzles are active for injecting the lubricating oil at specific piston positions, e.g. at or in the vicinity of the BDC, so that an increased amount of the lubricating oil can be introduced into the cooling channel so that the cooling efficiency for the piston head can be maintained at an acceptable level.

Such an arrangement provides some improvement in the piston head cooling technology for effective cooling of the piston head. However, on the other hand, such arrangement requires a plurality of lubricant injection nozzles. Furthermore, the lubricant nozzles are required to be arranged at positions for effectively introducing the lubricating oil to respectively corresponding cooling channels at the specific piston stroke position. Therefore, construction of the cooling arrangement becomes complicated and difficulty in production and assembly are encountered.

SUMMARY OF THE INVENTION

Therefore, it is an object of the present invention to provide a simplified cooling arrangement for a piston head of an internal combustion engine which can improve the efficiency of providing a lubricant oil as a piston head cooling medium.

Another subject of the invention is to provide a cooling arrangement which can effectively supply lubricating oil for a plurality of cooling channels which are oriented at mutually different radial positions.

In order to accomplish the aforementioned and other objects, there is provided, according to the present invention, a cooling arrangement for a piston head of an internal combustion engine including a plurality of cooling channels built-in to the piston head. Cooling medium induction paths and draining paths are formed through the piston head for introducing and draining cooling medium into and from the cooling channels. A single cooling medium injection nozzle is disposed within the engine cylinder. The cooling medium injection nozzle is oriented to inject the cooling medium so that an axis of a jet flow of the cooling medium injected from the cooling medium injection nozzle is aligned with the axes of the cooling medium induction paths at different stroke positions of a piston during an engine revolution cycle.

According to one aspect of the invention, a cooling arrangement for a piston head of an internal combustion engine, comprises:

- a plurality of cooling channels formed through the piston head and extending in a circumferential direction thereof;
- a plurality of induction paths and draining paths formed through the piston head, each induction and draining path being in communication with one of the cooling channels for introducing and draining a cooling medium;
- a cooling medium injection nozzle disposed within an engine cylinder for injecting cooling medium for forming flow directed to the induction paths; and wherein
- the induction paths are mutually offset in such a manner that the axes thereof are oriented in alignment with the axis of the flow of the injected cooling medium at different piston stroke positions in an engine revolution cycle.

In the preferred construction, the cooling channels are formed coaxially with respect to the axis of the piston head and at orientations mutually offset in a radial direction. The cooling medium injection nozzles may inject the cooling medium to form a flow of cooling medium which has an axis oblique to the axis of the piston head, and the induction paths are provided obliquely to the axis of the cooling medium flow for alignment at respectively predetermined piston stroke positions.

According to another aspect of the invention, a cooling arrangement for a piston head of an internal combustion engine, comprises:

- a first cooling channel formed through the piston head and extending in a circumferential direction thereof;

a second cooling channel formed through the piston head and extending in a circumferential direction thereof;

a first induction path formed through the piston head for communicating with the first cooling channel for introducing a cooling medium, the first induction path having a first axis extending obliquely to the axis of the piston head;

a second induction path formed through the piston head for communicating with the second cooling channel for introducing a cooling medium, the second induction path having a second axis essentially parallel to the first axis and thus extending obliquely to the axis of the piston head;

a cooling medium injection nozzle disposed within an engine cylinder for injection cooling medium for forming flow directed to the induction paths, the cooling medium injection nozzle being arranged for establishing the axis of cooling medium flow essentially parallel to the first and second axis of the first and second induction paths so that the cooling medium flow axis is aligned with each of the first and second induction paths at different piston stroke positions; and first and second drain paths connected to the first and second cooling channels respectively for draining the cooling medium from the cooling channels.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
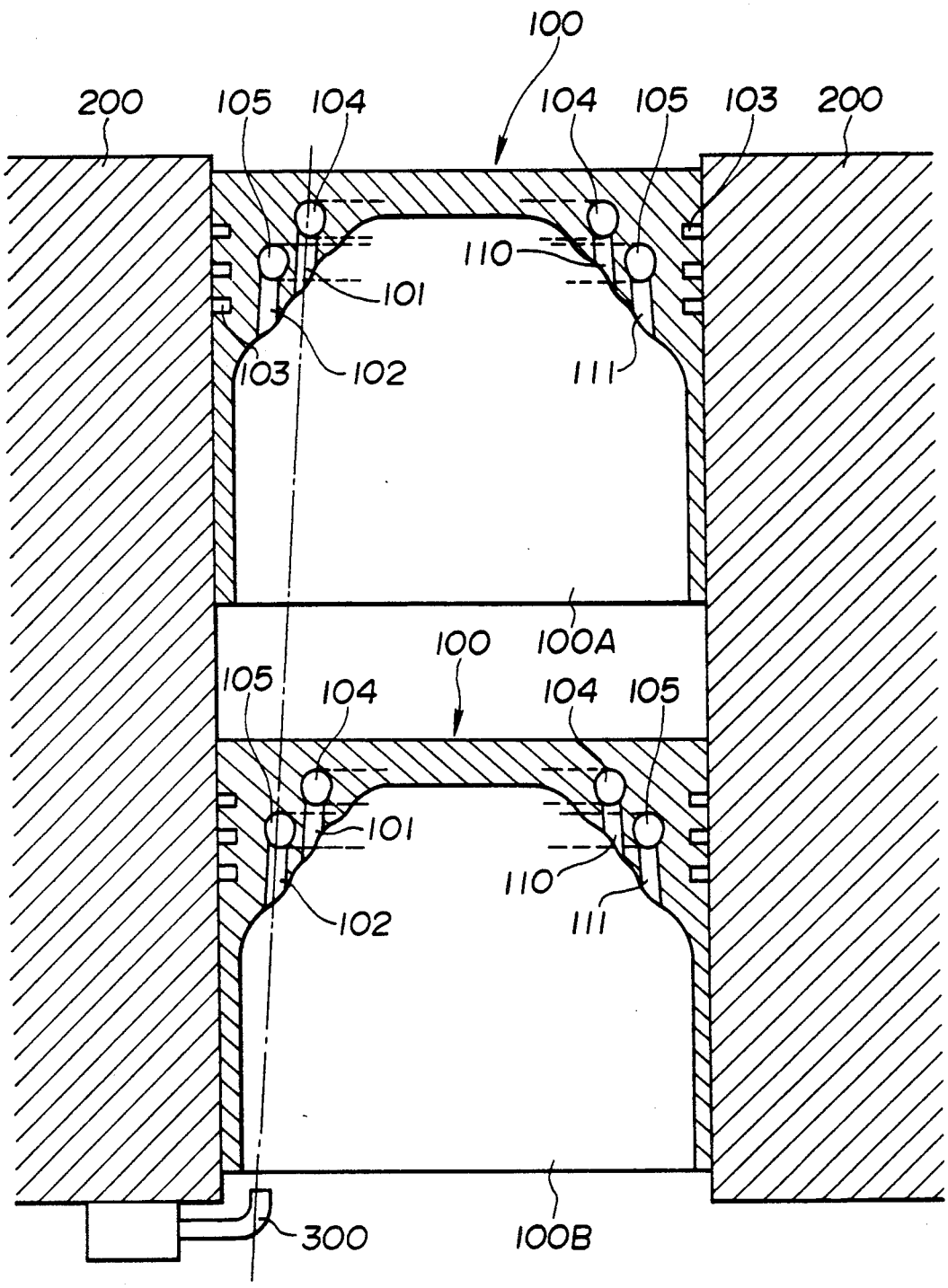
FIG. 1 is a section of an engine cylinder incorporating a first embodiment of a cooling arrangement for a piston head, according to the invention.

Referring now to the drawings, particularly to FIG. 1, the first embodiment of a cooling arrangement, according to the present invention, is applied for a piston head 100 thrustingly or reciprocally disposed within an engine cylinder 200. In FIG. 1, the piston head 100 is illustrated in positions at top-dead center (TDC) and bottom-dead-center (BDC) for the purpose of illustration. The piston head 100 at TD is identified by the reference numeral 100A and at BDC is identified by the reference numeral 100B. The piston head 100 is formed with upper and lower cooling channels 104 and 105 and a plurality of piston ring receptacle grooves 103. The upper and lower cooling channels 104 and 105 extend circumferentially through the overall circumference of the piston head 100. The upper cooling channel 104 is connected to a lubricant induction path 101 and a lubricant draining path 110. On the other hand, the lower cooling channel 105 is connected to a lubricant induction path 102 and a lubricant draining path 111.

A lubricant injection nozzle 300 is provided in the vicinity of the bottom of the engine cylinder 200 and protrudes into the interior space of the engine cylinder for injecting lubricant oil as a cooling medium. The lubricant injection nozzle 300 injects lubricating oil for forming a jet flow of the injected lubricating oil along a jet flow axis illustrated by one-dotted chain line. As can be seen, the jet flow axis is skewed with respect to the center axis of the piston.

As can be seen, the axes of the lubricant induction paths 101 and 102 are skewed to be oblique with respect to the center axis of the piston head 100. The skew angle of the lubricant induction paths 101 and 102 are the same as that of the axis of the jet flow of lubricating oil. The lower ends of the lubricant induction paths 101 and 102 are oriented to be positioned on the jet flow axis of the lubricating oil at TDC and BDC of the piston stroke. Namely, at TDC of the piston, the axis of the lubricant induction path 101 is aligned with the jet flow axis of the lubricating oil for effectively introducing the lubricating oil. Therefore, at TDC, the lubricating oil as the cooling medium is supplied to the upper cooling channel 104. On the other hand, at BDC, the axis of the lubricant induction path 102 is aligned with the jet flow axis of the lubricant to introduce lubricant oil into the cooling channel 105.

Lubricating oil is introduced into the cooling channels 104 and 105 circulates through the cooling channels for cooling the piston head, and then is drained through the drain paths 110 and 111.

Therefore, according to the embodiment of FIG. 1, lubricating oil can be effectively supplied for both of the upper and lower cooling channels 104 and 105 and the piston head can be effectively cooled.

Figure 2:
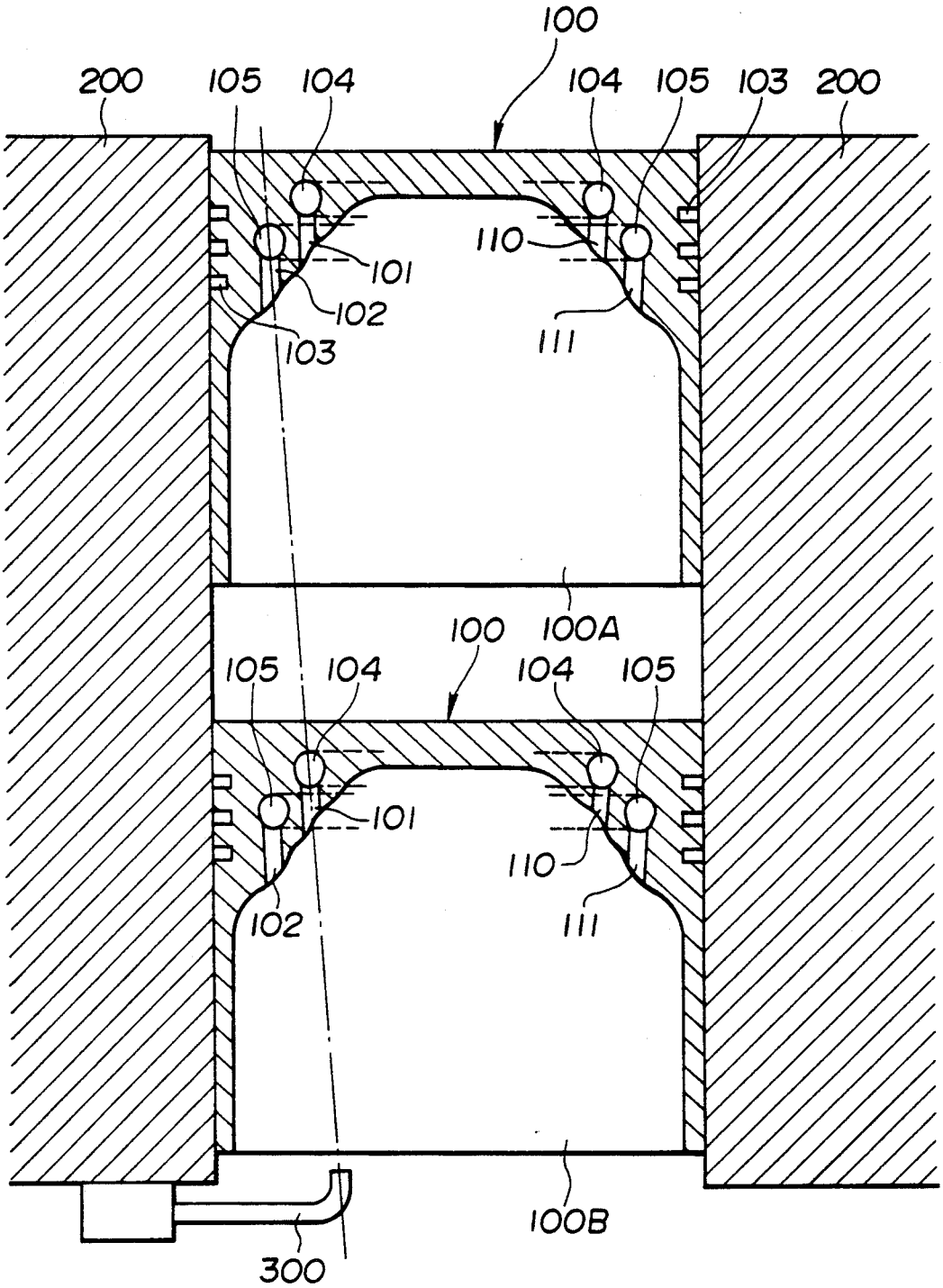
FIG. 2 is a section of an engine cylinder incorporating a second embodiment of a cooling arrangement for a piston head, according to the invention.

FIG. 2 shows a second embodiment of the piston head cooling arrangement according to the present invention. In this embodiment, the lubricant injection nozzle 300 is oriented at a position in the vicinity of the center of the engine cylinder to form a jet flow of the injected lubricating oil. As can be seen from FIG. 2, the skew direction of the jet flow of the lubricating oil is opposite to that in the first embodiment. Therefore, the skew directions of the lubricant induction paths 101 and 102 are opposite to those in the embodiment of FIG. 1. With such a construction, the axis of the lubricant induction path 102 is aligned with the jet flow axis of the injected lubricating oil at TDC of the piston. On the other hand, the axis of the lubricant induction path 101 is aligned with the jet flow axis of the lubricating oil at BDC. Therefore, at TDC, lubricating oil is introduced into the lower cooling channel 105 and, at BDC, lubricating oils is introduced into the upper cooling channel 104.

Figure 3:
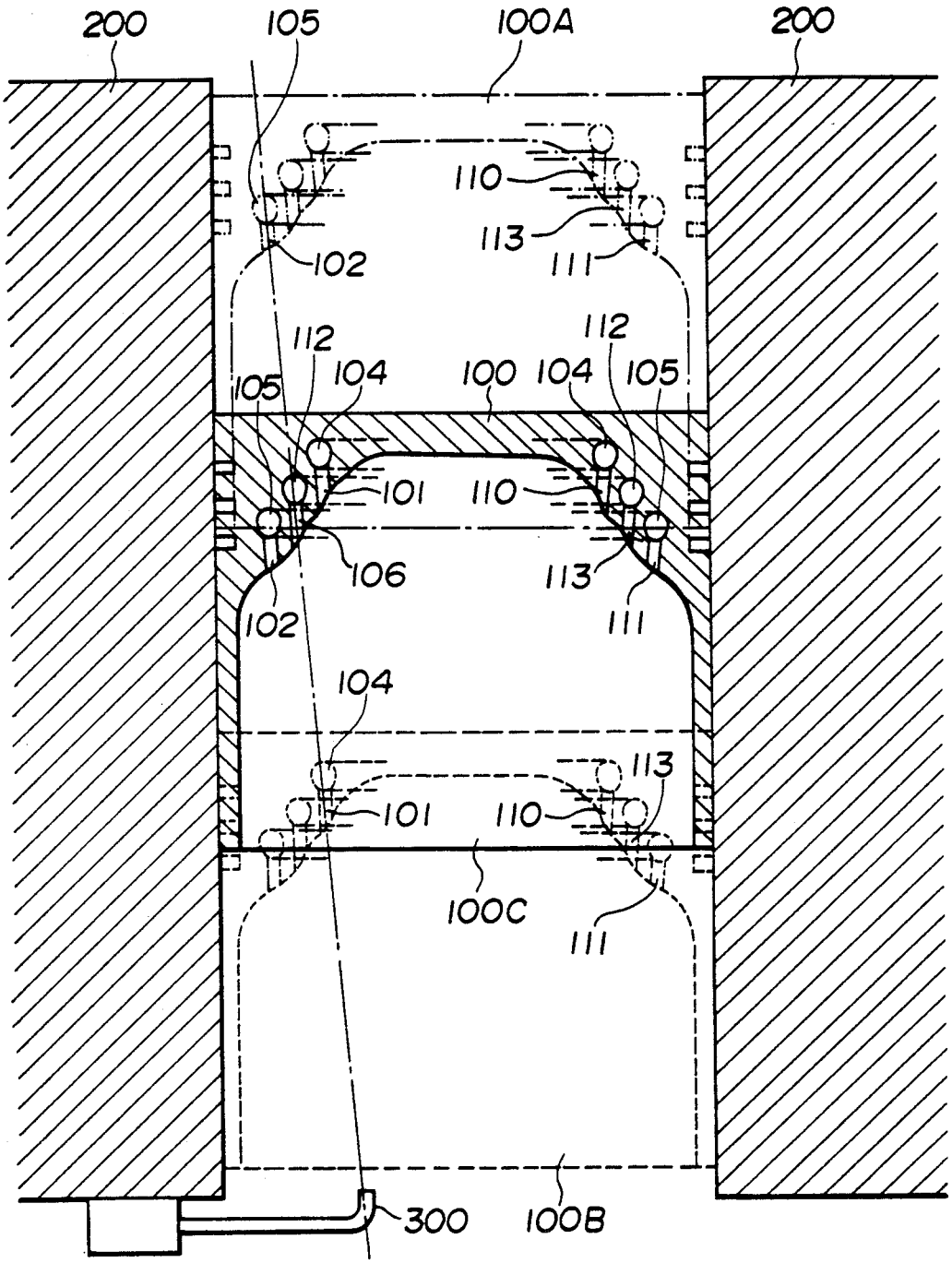
FIG. 3 is a section of an engine cylinder incorporating a third embodiment of a cooling arrangement for a piston head, according to the invention.

FIG. 3 shows a third embodiment of the piston head cooling arrangement, according to the present invention. As can be seen from FIG. 3, this embodiment is formed by modifying the foregoing second embodiment of FIG. 2. Therefore, the components common to the former embodiment will be represented by the same reference numerals and a detailed discussion of these components will be avoided in order to avoid redundancy. In this embodiment, additional intermediate cooling channel 112 is provided at a height level intermediate the upper and lower cooling channels 104 and 105. The intermediate cooling channel 112 is connected to a lubricant induction path 106 and a lubricant draining path 113. The skew axis of the lubricant induction path 106 is designed for alignment with the jet flow axis of the injection lubricating oil, at the intermediate position (100C) between TDC (100A) and BDC (100B). With this construction, lubricant oil as the cooling medium can be supplied even at the intermediate position of the piston stroke.

As can be appreciated, the present invention successfully fulfills all desired objects and advantages.

While the present invention has been discussed hereinabove in terms of the preferred embodiments of the present invention, the invention is not restricted to the shown embodiments. The invention can be embodied in various fashions. Therefore, the invention should be interpreted to include all possible embodiments and modifications which can be embodied therein without departing from the principle of the invention set out in the appended claims.

What is claimed is:

1. A cooling arrangement for a piston head of an internal combustion engine, comprising:

a plurality of cooling channels formed through the piston head and extending in a circumferential direction thereof;

a plurality of induction paths and draining paths formed through the piston head, each induction and draining path being in communication with one of said cooling channels for introducing and draining a cooling medium;

a cooling medium injection nozzle disposed within an engine cylinder for injecting cooling medium for forming flow directed to said induction paths; and wherein said induction paths are mutually offset in such a manner that the axes thereof are oriented in alignment with the axis of the flow of the injected cooling medium at different piston stroke positions in an engine revolution cycle.

2. A cooling arrangement for a piston head as set forth in claim 1, wherein said plurality of cooling channels are formed coaxially with respect to the axis of said piston head and at orientations mutually offset in a radial direction.

3. A cooling arrangement for a piston head as set forth in claim 1, wherein said cooling medium injection nozzle injects said cooling medium to form said flow of cooling medium, wherein said injected cooling medium has an axis oblique to the axis of said piston head, and said induction paths are provided obliquely to said axis of the cooling medium flow for alignment at respectively predetermined piston stroke positions.

4. A cooling arrangement for a piston head of an internal combustion engine, comprising:

a first cooling channel formed through the piston head and extending in a circumferential direction thereof;

a second cooling channel formed through the piston head and extending in a circumferential direction thereof;

a first induction path formed through the piston head for communicating with said first cooling channel for introducing a cooling medium, said first induction path having a first axis extending obliquely to the axis of said piston head;

a second induction path formed through the piston head for communicating with said second cooling channel for introducing a cooling medium, said second induction path having a second axis essentially parallel to said first axis and thus extending obliquely to the axis of said piston head;

a cooling medium injection nozzle disposed within an engine cylinder for injecting cooling medium for forming flow directed to said induction paths, said cooling medium injection nozzle being arranged for establishing the axis of cooling medium flow essentially parallel to said first and second axis of said first and second induction paths so that the cooling medium flow axis is aligned with each of said first and second induction paths at different piston stroke positions' and first and second drain paths connected to said first and second cooling channels respectively for draining the cooling medium from said cooling channels.

5. A cooling arrangement for a piston head as set forth in claim 4, wherein said plurality of cooling channels are formed coaxially with respect to the axis of said piston head and at orientations mutually offset in a radial direction.

* * * * *